US006648613B2

(12) United States Patent
Clausson et al.

(10) Patent No.: US 6,648,613 B2
(45) Date of Patent: Nov. 18, 2003

(54) FAN BLOWER ASSEMBLY WITH ONE-PIECE AIR DIFFUSER AND BAYONET-STYLE END CAP

(75) Inventors: Earl J. Clausson, Kent, OH (US); Timothy J. Drapcho, Dover, OH (US); William E. Anstine, North Canton, OH (US)

(73) Assignee: Ametek, Inc., Kent, OH (US)

( * ) Notice: Subject to any disclaimer, the term of this patent is extended or adjusted under 35 U.S.C. 154(b) by 0 days.

(21) Appl. No.: 10/014,047

(22) Filed: Dec. 11, 2001

(65) Prior Publication Data

US 2003/0108442 A1 Jun. 12, 2003

(51) Int. Cl.[7] ..... F04B 17/03

(52) U.S. Cl. ..... 417/423.1; 417/417; 417/423.7; 417/433.14; 310/89; 310/71; 310/258; 415/208.2; 415/211.2

(58) Field of Search ..... 417/423.1, 423.7, 417/423.14, 423.12; 310/89, 71, 258; 415/208.2, 211.2, 213.1

(56) References Cited

U.S. PATENT DOCUMENTS 4,851,725 A * 7/1989 Keck ..... 310/71
4,969,797 A * 11/1990 Takara et al. ..... 415/113
5,296,769 A * 3/1994 Havens et al. ..... 310/90
5,408,154 A * 4/1995 Meiser et al. ..... 310/71
5,734,214 A * 3/1998 Gilliland et al. ..... 310/89
5,845,390 A * 12/1998 Cheng et al. ..... 29/596
5,861,689 A * 1/1999 Snider et al. ..... 310/71
5,986,379 A * 11/1999 Hollenbeck et al. ..... 310/257
6,011,339 A * 1/2000 Kawakami ..... 310/208
6,429,557 B2 * 8/2002 Sheeran et al. ..... 310/71

* cited by examiner

*Primary Examiner*—Cheryl J. Tyler
*Assistant Examiner*—Emmanuel Sayoc
(74) *Attorney, Agent, or Firm*—Renner, Kenner, Greive, Bobak, Taylor & Weber

(57) ABSTRACT

A blower assembly includes a rotor assembly having a shaft and a stator assembly coupled to the rotor assembly. A shrouded fan assembly is coupled to the shaft so as to generate an air flow when the shaft rotates. A unitary diffuser having a fan side opposite a motor side, is included wherein the fan side is coupled to the shrouded fan assembly. The unitary diffuser has ports for transferring the air flow from said fan side to said motor side. The motor side has a stator wall that partially encloses the stator assembly and the rotor assembly. An end cap is coupled to the stator wall for further enclosing the stator assembly and the rotor assembly. The assembly also includes a plurality of termination boxes disposed about the periphery of the stator wall for terminating the wire windings of the stator assembly. The end cap has at least one tab, and the stator wall has at least one tab receptacle that slidably receives the tab. A spring is interposed between the end cap and the rotor assembly to bias the end cap into a secure position with respect to the stator wall.

19 Claims, 6 Drawing Sheets

FAN BLOWER ASSEMBLY WITH ONE-PIECE AIR DIFFUSER AND BAYONET-STYLE END CAP

TECHNICAL FIELD

The invention herein resides in the art of air moving device which also may be referred to as blower assemblies. More particularly, the present invention relates to a blower device which is compact and has a low manufacturing cost. Specifically, the present invention relates to a blower assembly which combines a diffuser, termination devices and a motor housing into a single component that eliminates the need for mechanical fasteners normally used to secure the aforementioned components to one another.

BACKGROUND ART

It is known to use fan/blower assemblies in a wide variety of applications ranging from vacuum cleaners to assisted breathing apparatuses. Indeed, these blowers hold sheets of paper in place as ink-jet printer heads pass over and dispense ink thereon. Therefore, it is critical that the fan/blower assembly generate a dependable air flow to securely hold the paper in place during the printing process and to prevent the printed product from smudging.

Of course, cost and product quality are critical factors in manufacturing a blower assembly that can be adapted for printers as well as other applications. Typically, a blower assembly requires multiple manufacture of parts that are assembled to one another. In particular, prior art blower assemblies utilize a motor assembly that includes a rotor and a stator wherein the rotor carries a shaft. Motor windings around the stator are terminated to various tab devices. After termination, the stator is secured within a housing whereupon the rotor/shaft is installed. The housing is typically employed for holding the stator and a diffuser while a shrouded fan is rotated by the shaft to draw air into the shroud axially. The air is then distributed by the diffuser. The diffuser and stator are assembled to the housing with fasteners. Costs for delivering these parts to different manufacturing stations and the cost for maintaining the additional inventory can become quite prohibitive. Therefore, there is a need to simplify the assembly process while still maintaining a high quality blower assembly product.

DISCLOSURE OF INVENTION

In light of the foregoing, it is first aspect of the present invention to provide a fan/blower assembly with a one-piece air diffuser and bayonet-style end cap.

It is a further aspect of the present invention as to provide a blower assembly which includes a motor assembly that comprises a rotor and a stator, and a fan assembly driven by the motor assembly.

It is still a further aspect of the present invention is to provide a blower assembly, as set forth above, wherein a unitary diffuser is interposed between the motor assembly and the fan assembly and wherein the diffuser functions as a motor housing, a diffuser and a stator assembly termination device.

An additional aspect of the present invention is to provide a blower assembly, as set forth above, wherein the unitary diffuser provides an integral stator wall for partially enclosing the stator assembly.

A further aspect of the present invention is to provide a blower assembly, as set forth above, wherein the end cap further encloses the stator assembly and is releasably securable to the stator wall.

Yet a further aspect of the present invention is to provide a blower assembly, as set forth above, wherein the end cap has outwardly extending tabs received in a tab receptacle device provided by the stator wall, and wherein the end cap is spring-biased to lock the end cap in place with respect to the stator wall.

Still yet another aspect of the present invention is to provide a blower assembly, as set forth above, wherein a plurality of termination boxes with notches that receive motor winding wires are integral with the stator wall.

Still yet another aspect of the present invention is to provide a blower assembly wherein a cover may be attached to completely enclose the unitary diffuser on a side opposite the fan assembly to allow for uniform air flow from one end of the assembly to the other.

The foregoing and other aspects of the invention which shall become apparent as the detailed description proceeds, are achieved by a blower assembly, comprising a rotor assembly having a shaft; a stator assembly coupled to the rotor assembly; a shrouded fan assembly coupled to the shaft so as to generate an air flow when the shaft rotates; a unitary diffuser having a fan side opposite a motor side, the fan side coupled to the shrouded fan assembly, the unitary diffuser having ports for transferring the air flow from the fan side to the motor side, the motor side having a stator wall that partially encloses the stator assembly and the rotor assembly; and an end cap coupled to the stator wall for further enclosing the stator assembly and the rotor assembly.

The present invention also provides a diffuser for a blower assembly, wherein the diffuser carries a motor assembly and a shrouded fan assembly, the motor assembly having a shaft that rotates a fan in the shrouded fan assembly, the diffuser comprising a plate having a fan side opposite a motor side and a shaft hole therethrough, the plate having a plurality of ports extending therethrough; a stator wall extending from the motor side, the stator wall partially enclosing the motor assembly and an end cap coupled to the stator wall for further enclosing the motor assembly.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
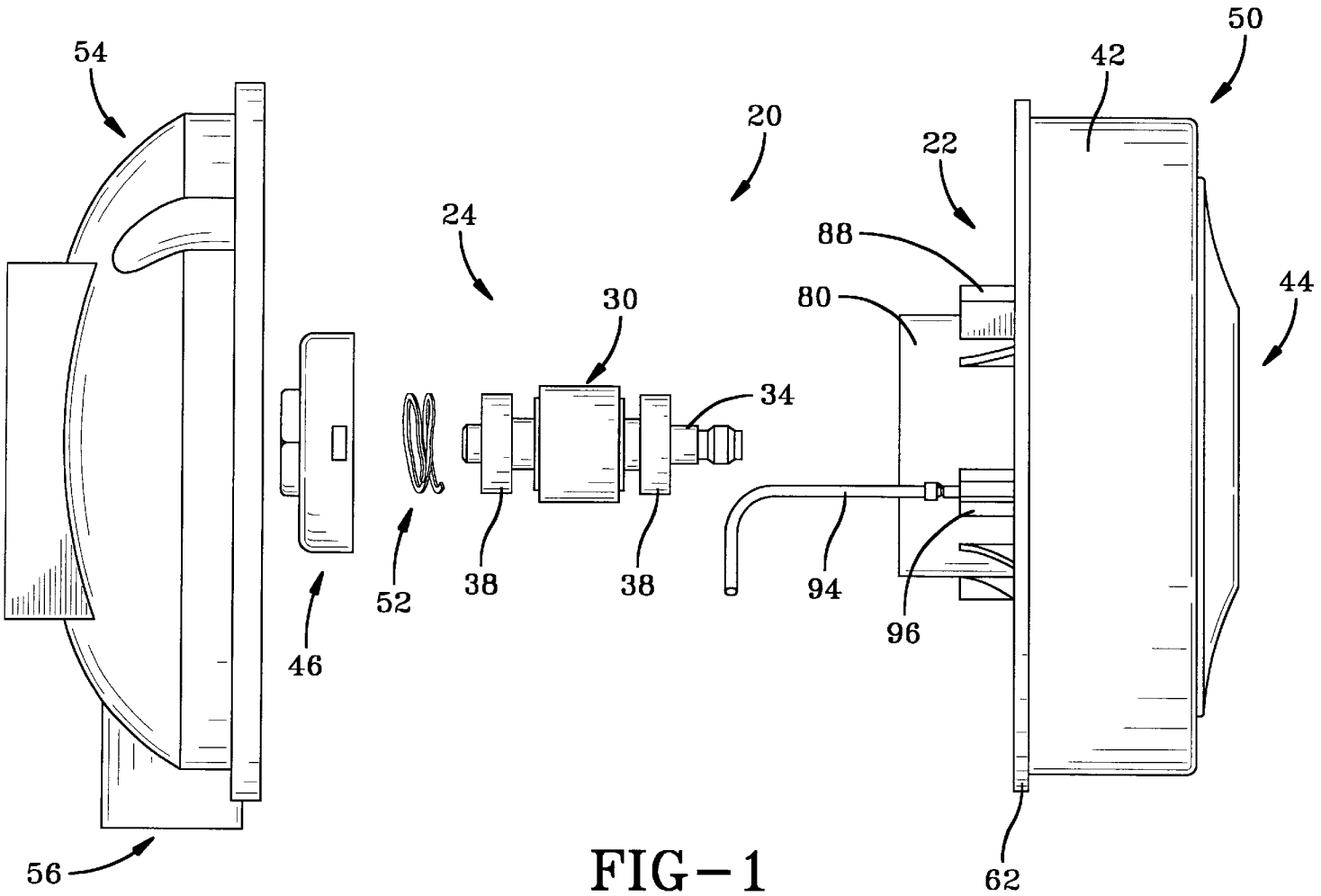
FIG. 1 is an assembly drawing of a blower assembly according to the present invention.
Figure 2:
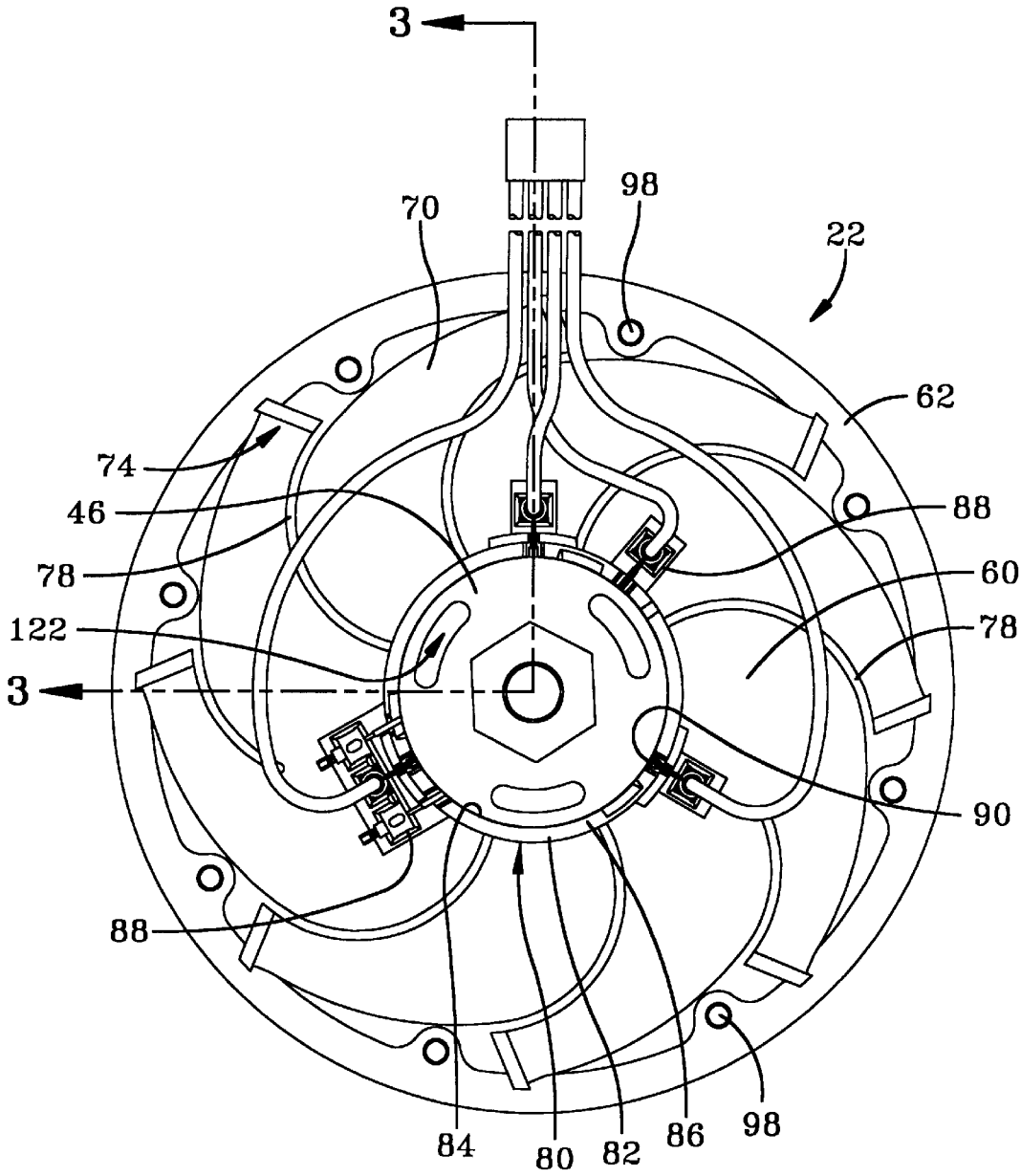
FIG. 2 is a elevational view of a unitary diffuser contained within the blower assembly.
Figure 3:
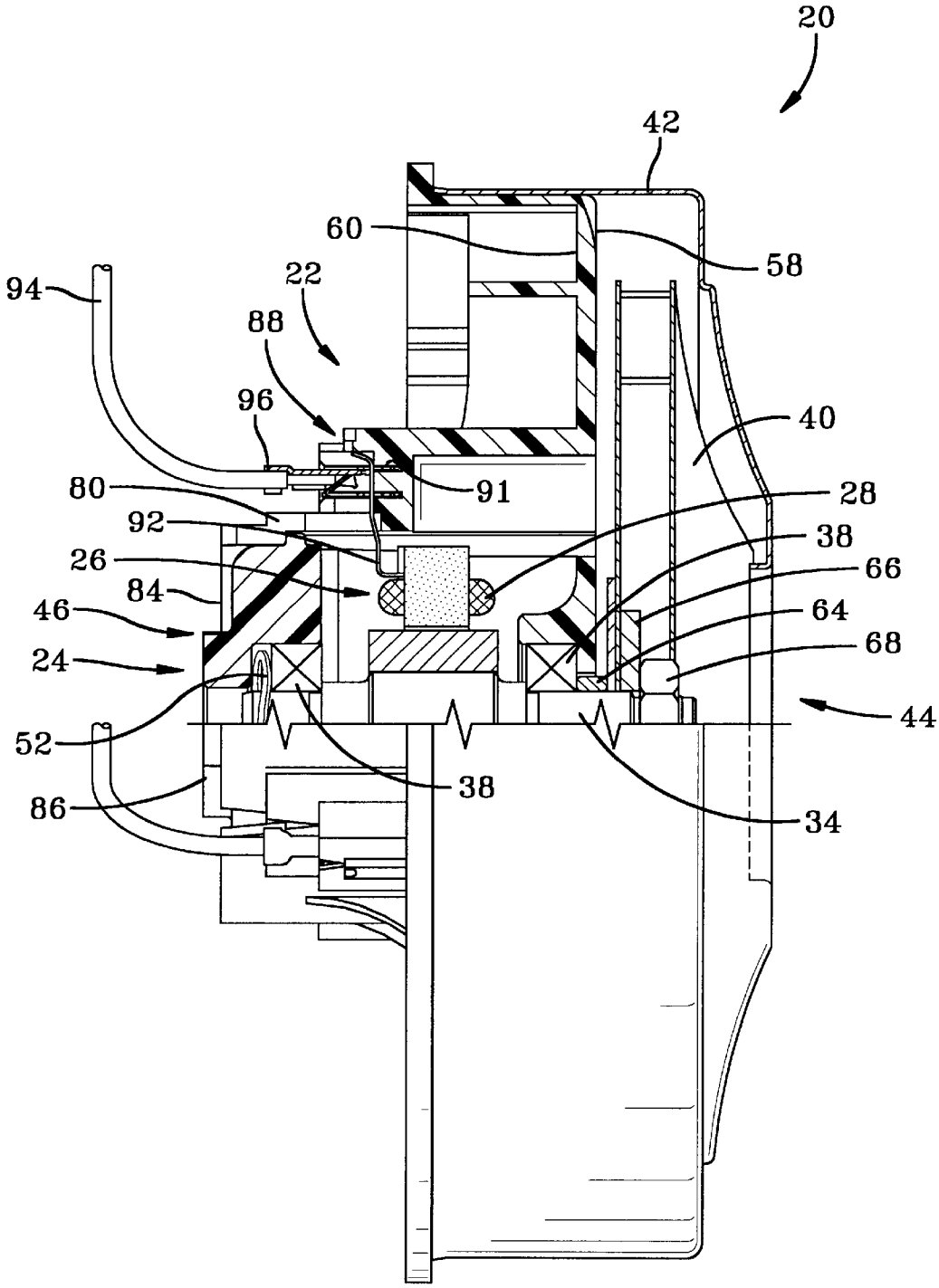
FIG. 3 is a partial cross-sectional view of the blower assembly taken along lines 3—3 of FIG. 2.
Figure 6:
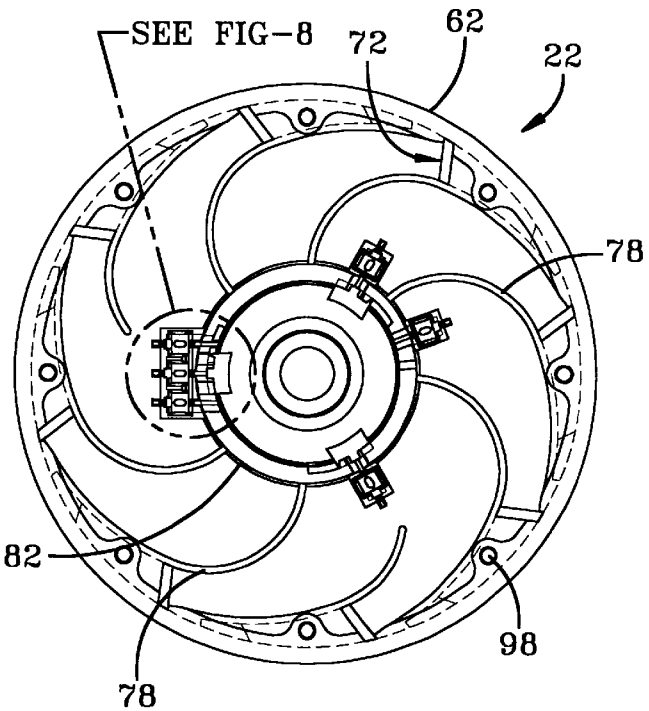
FIG. 6 is an elevational view of the unitary diffuser without an end cap.
Figure 5:
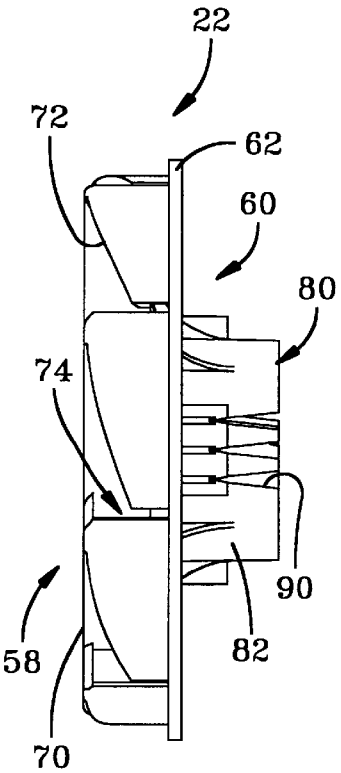
FIG. 5 is a side elevational view of the unitary diffuser.
Figure 4:
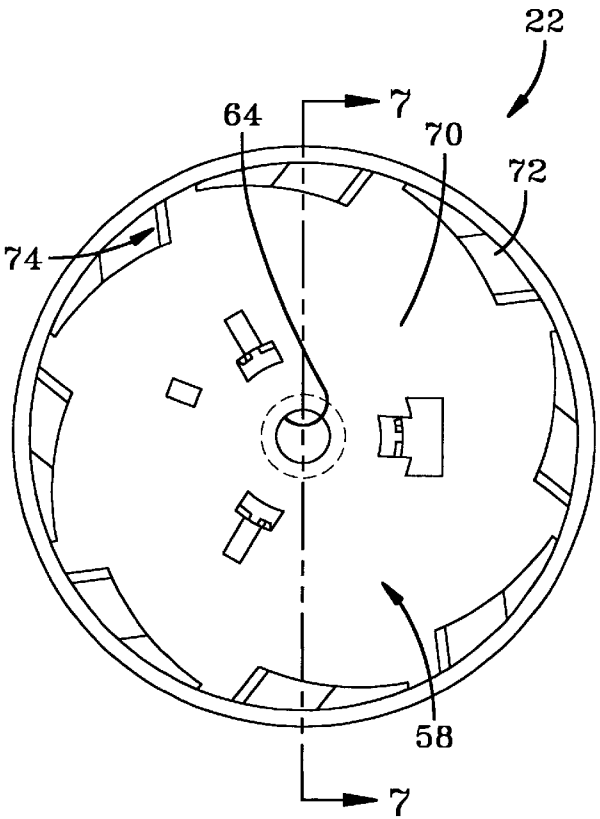
FIG. 4 is an opposite elevational view of the unitary diffuser.

Referring now to the drawings and, more particularly, to FIGS. 1–3, it can be seen that a blower/fan assembly according to the present invention is designated generally by the numeral 20. The blower assembly 20 generally includes a unitary diffuser 22 which carries a motor assembly 24. As is common with all motor assemblies utilized in blower and fan applications, the assembly 24 includes a stator assembly 26 which has motor windings 28 and a rotor assembly 30 which is received therein. The rotor assembly 30 carries a shaft 34 that has a bearing 38 secured to each end thereof. Secured to one end of the shaft 34 is a fan 40 which is enclosed by a shroud 42 that has an inlet 44. The fan 40 and the shroud 42 provide a shrouded fan assembly 50 that is coupled to the unitary diffuser 22. The shroud 42 is press fit onto the unitary diffuser 22, although it could be secured by fasteners or the like.

An end cap 46 is employed to maintain the motor assembly 24 in position with respect to the unitary diffuser 22 in a manner that will be fully described below. A stainless steel wave spring 52 is interposed between the end cap 46 and the motor assembly 24 for proper positional location of the motor assembly 24 with respect to the unitary diffuser 22. In certain applications, a cover 54 may be secured to the unitary diffuser 22 by fasteners, a snap fit or other attachment mechanism, wherein the cover 54 has an outlet 56. In operation, when the motor assembly 24 is energized, the fan 40 is rotated and axially draws air in through the inlet 44. This air is moved by the fan through the diffuser 22 and is expelled about the motor assembly 24 or through the outlet 56 if the cover 54 is provided.

Referring now to FIGS. 4–9, and with occasional reference to FIGS. 1–3, it can be seen that the unitary diffuser 22 provides a fan side 58 that is adjacent the shrouded fan assembly 50 and a motor side 60 which is adjacent the motor assembly 24. The unitary diffuser 22 provides a rim 62 upon which the shroud 42 is seated when completely installed. The unitary diffuser also includes a shaft hole 64 extending from the fan side 58 to the motor side 60 which allows for receipt of the shaft 34. A spacer 66 is positioned upon the shaft 38 to provide spacing between the fan side 58 and a bottom plate of the fan 40. A fastener 68 is employed to secure the fan 40 to the shaft 34 in a manner well known in the art.

The fan side 58 includes a plate 70 which defines a top surface of the unitary diffuser 22. Spaced about the outer periphery of the plate 70 are a plurality of scalloped ramps 72 which extend downwardly from the plate 70 toward the rim 62. It will be appreciated that the ramps 72 are positioned about the outer periphery of the fan and the ramps widen as they proceed downwardly into respective ports 74 which extend from the fan side 58 through to the motor side 60. Accordingly, as the fan 40 draws air through the inlet 44 it is distributed radially and is then directed down the scalloped ramps 72 through the ports 74.

The motor side 60, which is disposed on the opposite side of the plate 70, includes a plurality of curvilinear vanes 78 which are aligned with the ports 74. These curvilinear vanes 78 facilitate the air flow through the blower assembly 20.

A stator wall 80 is preferably concentrically positioned and extends axially from the motor side of the plate 70. The stator wall 80 includes an outer surface 82 opposite an inner surface 84 which are joined to one another by a top edge 86. Disposed about the outer surface 82 of the stator wall 80 are a plurality of termination boxes 88 which may also be integral with the underside of the plate 70. Each termination box 88 is provided with a corresponding notch 90.

Depending upon the configuration of the motor—the number of poles and the like—a terminal 91 may be installed in some or all of the termination boxes 88. In any event, a wire 92 from the windings 28 is terminated in the terminal 91. In order to transmit electricity to the blower assembly 20 a wire 94 with an attached spade terminal 96 is inserted into the terminal 91. A plurality of holes 98 may be distributed about the outer periphery of the diffuser 22 as shown. These holes are for receiving fasteners that secure the cover 54 to the assembly if desired. The cover 54 may also be press fit or snap fit onto the rim 62.

Figure 9:
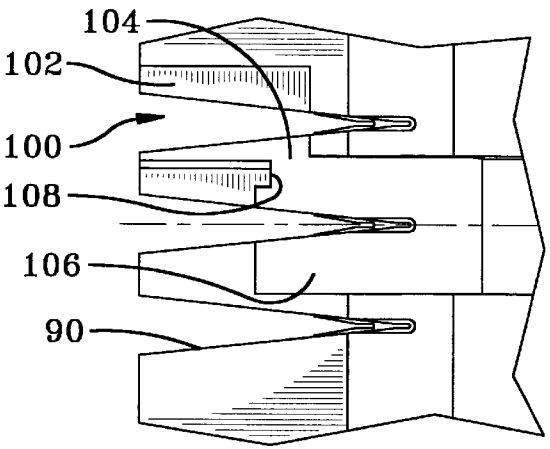
FIG. 9 is an enlarged view of the stator wall and a tab receptacle.
Figure 8:
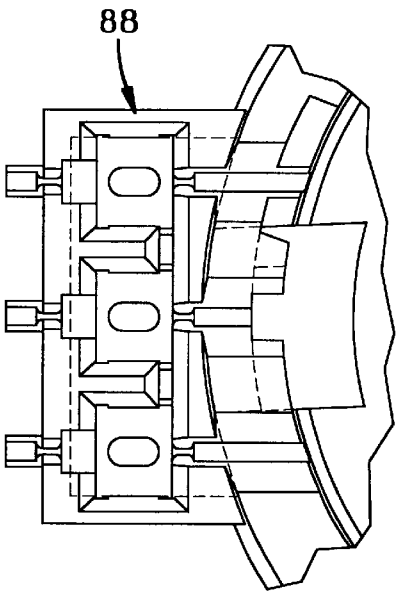
FIG. 8 is an enlarged view of a plurality of termination boxes integral with a stator wall of the unitary diffuser.
Figure 7:
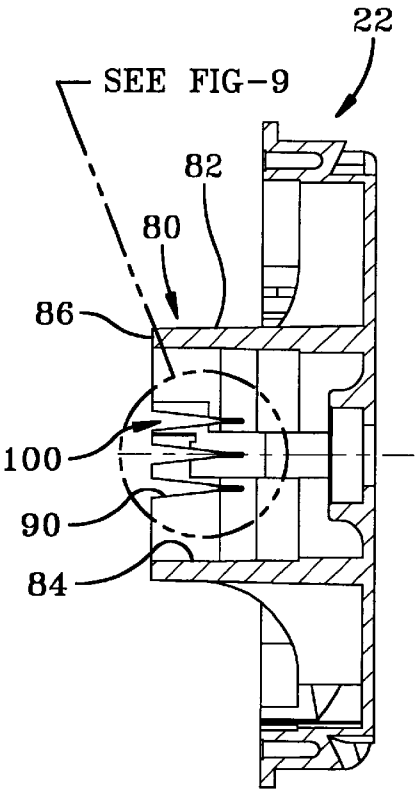
FIG. 7 is a cross-sectional view taken along lines 7—7 of FIG. 4 of the unitary diffuser.

Referring now to FIGS. 7–9 it can be seen that the inner surface 84 of the stator wall provides at least one tab receptacle 100 which includes an entry channel 102 that is axially directed with respect to the stator wall. Extending substantially perpendicularly from the entry channel 102 is a lateral channel 104. Extending substantially perpendicularly from the end of the lateral channel 104 is a holding channel 106 which is also axially directed and substantially parallel with the entry channel 102. A ridge 108 is provided at a corner of the holding channel 106. The channels 102, 104 and 106 are all of essentially the same depth with respect to the inner surface 84.

Figure 12:
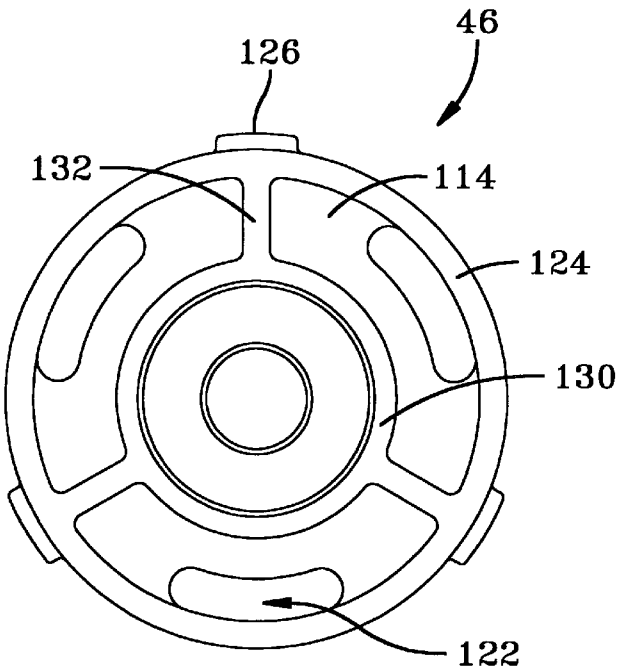
FIG. 12 is an opposite elevational view of the end cap.
Figure 11:
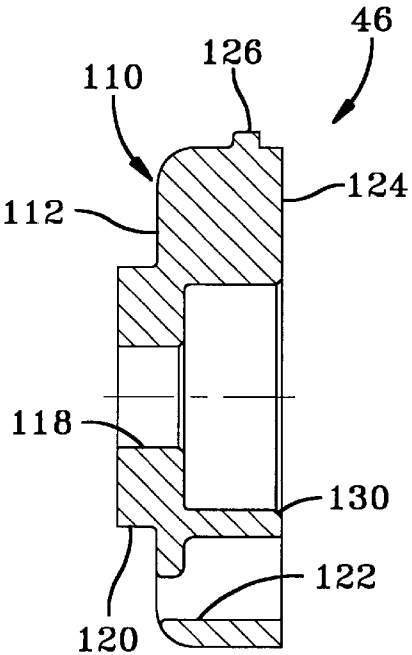
FIG. 11 is a cross-sectional view of the end cap taken along lines 11—11 of FIG. 10.
Figure 10:
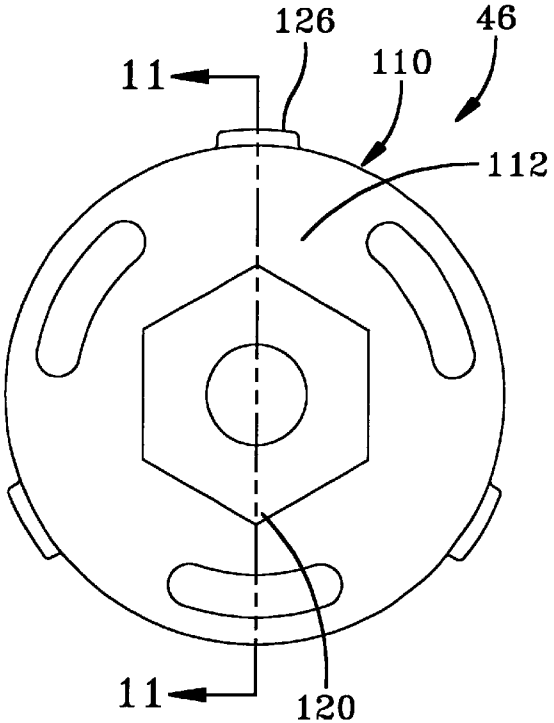
FIG. 10 is an elevational view of an end cap.

Referring now to FIGS. 10–12 a detailed description of the end cap 46 is provided. The end cap 46 includes a disk 110 which has a locking side 112 opposite a spring side 114. A shaft hole 118 extends through the disk 110 at a centrally located position and is large enough to allow rotation of the shaft 34 when the end cap 46 is assembled to the diffuser 22. The lock side 112 includes a hex boss 120 that it is disposed around the shaft hole 118. Although the boss is shown in a hexagonal configuration it will be appreciated that the boss 120 may be any non-circular protrusion which allows for turning of the end cap 46 with a tool in an assembly process. The cap also provides a plurality of vent slots 122 which allow for dissipation of heat from the motor assembly.

The spring side 114 provides a cap ring 124 extending from the outer periphery of the disk 110. A plurality of pilot tabs 126 extend outwardly from the ring 124. A bearing collar 130 is concentric with the cap ring 124 and extends from an inner periphery of the spring side 114. A plurality of ribs 132 provide structural support between the bearing collar 130 and the cap ring 124.

With reference to FIGS. 7–12 and FIG. 3 the assembly of the blower assembly will now be described in detail. The stator assembly 26 is substantially circular in construction and is sized to fit within the interior of the stator wall 80. The stator assembly is simply positioned in place and can be held by an adhesive or other locating features incorporated into the stator wall 80. An end of each winding of the stator assembly is positioned through the appropriate notches 90 as dictated by the number of terminals utilized and the number of windings required to generate the appropriate power by the motor. At this time, terminals 91 are installed into the termination boxes 88 so as to hold the wire ends 92 in place and to make an electrical connection thereto. This allows for later assembly of the wire harness embodied in the wires 94 and their attached spade terminals 96. Once the assembly of the stator assembly within the stator wall is complete, the rotor assembly with attached shaft and bearings are inserted into the stator assembly. The fan assembly is attached to the end of the shaft whereupon the shroud is press fit onto the unitary diffuser 22.

In the next phase of the assembly, the end cap 46 is assembled to the stator wall 80. First, the wave spring 52 is positioned within the bearing collar 130. A bit of lubricating grease may be disposed about the bearing collar area. Next the cap is oriented with the hex boss facing outwardly and the pilot tabs 126 are aligned with the corresponding receptacles 100. In particular, the tabs 126 fit into the entry channels 102 and the end cap is pressed axially downwardly such that spring 52 is compressed against the proximal bearing 38. The end cap 46 is then rotated by a tool engaging the hex boss 120 so that the pilot tabs 126 enter the respective lateral channel 104. Once the tabs 126 reach the end of the lateral channel 104, the tool 120 and corresponding force is removed from the hex boss 120 and the spring biases the cap upwardly along the holding channel 106. The ridge 108 functions to maintain the pilot tabs 126 within the holding channel 106. The wiring harness may then be attached to the termination boxes and the assembly is complete unless the cover is desired to be installed.

From the foregoing description, the advantages of the present invention are readily apparent. Primarily, the end cap 46, in conjunction with the unitary diffuser, allows for low-cost assembly of a blower or vacuum device. In this construction, the diffuser functions as a device for creating an axial flow of air which may then be directed as desired, and also as a motor housing for securely containing the stator and rotor assemblies in a controlled position. Likewise, such a construction allows for efficient and quality manufacturing of a blower assembly. Yet a further advantage of the present invention is that it allows for termination of the motor windings without the need for special tools that would otherwise be required. It will be appreciated that the relationship between the stator wall 80 and the end cap 46 may be modified such that the tabs are provided internally or externally from the stator wall, while the end cap is provided with the appropriate channels for receiving the tabs to allow for a spring biasing of the end cap for attachment to the wall. Likewise, it is also envisioned that the termination boxes may be configured in other positions with respect to the stator wall or they may extend upwardly from the curvilinear vanes, without connection to the stator wall, if desired. It is yet another advantage of the present invention to provide the notches so that they are aligned with the termination boxes and also with the holding channels 106 to maintain the windings in position.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A blower assembly, comprising:

a rotor assembly having a shaft;

a stator assembly coupled to said rotor assembly;

a shrouded fan assembly coupled to said shaft so as to generate an air flow when said shaft rotates;

a unitary diffuser having a fan side opposite a motor side, said fan side coupled to said shrouded fan assembly, said unitary diffuser having ports for transferring the air flow from said fan side to said motor side, said motor side having a stator wall that partially encloses said stator assembly and said rotor assembly;

an end cap coupled to said stator wall for further enclosing said stator assembly and said rotor assembly; and a plurality of termination boxes disposed about the periphery of said stator wall, said stator assembly having wire windings that are terminated in at least some of said termination boxes, wherein said stator wall has a plurality of notches, each said notch is aligned with a corresponding termination box, wherein said wire windings pass through said notches.

2. The blower assembly according to claim 1, further comprising:

a spring interposed between said end cap and said rotor assembly to bias said end cap into a secure position.

3. The blower assembly according to claim 1, wherein said motor side has a plurality of curvilinear vanes extending between said ports and said stator wall.

4. The blower assembly according to claim 1 further comprising:

a cover having an outlet, wherein said cover is secured to said motor side of said unitary diffuser.

5. The blower assembly according to claim 1, wherein said end cap has at least one tab, and wherein said stator wall has at least one tab receptacle, said at least one tab receivable in said at least one tab receptacle to releasably secure said end cap to said stator wall.

6. The blower assembly according to claim 5, further comprising:

a spring interposed between said end cap and said rotor assembly to bias said end cap into a secure position.

7. The blower assembly according to claim 6, wherein said tab receptacle is formed on an inner surface at said stator wall, said tab receptacle having an entry channel extending from a top edge of said stator wall, a lateral channel extending substantially perpendicularly from said entry channel, and a holding channel extending substantially perpendicularly from said lateral channel, and wherein said tab is movable through said entry channel and said lateral channel and biasingly held by said spring in said holding channel.

8. The blower assembly according to claim 7, wherein said end cap has a non-circular member extending from one side and a bearing collar extending from an opposite side, said bearing collar receiving said spring, wherein said non-circular member facilitates securement of said end cap to said stator wall.

9. The blower assembly according to claim 8, wherein said holding channel is aligned with said notch.

10. A blower assembly, comprising:

a rotor assembly having a shaft;

a stator assembly coupled to said rotor assembly;

a shrouded fan assembly coupled to said shaft so as to generate an air flow when said shaft rotates;

a unitary diffuser having a fan side opposite a motor side, said fan side coupled to said shrouded fan assembly, said unitary diffuser having ports for transferring the air flow from said fan side to said motor side, said motor side having a stator wall that partially encloses said stator assembly and said rotor assembly, wherein said motor side has a plurality of curvilinear vanes extending between said ports and said stator wall;

an end cap coupled to and position within the said stator wall for further enclosing said stator assembly and said rotor assembly; and a cover having an outlet, wherein said cover is secured to said motor side of said unitary diffuser.

11. The blower assembly according to claim 10, further comprising:

a plurality of termination boxes disposed about the periphery of said stator wall, said motor assembly having wire windings that are terminated in at least some of said termination boxes.

12. The blower assembly according to claim 11, wherein said stator wall has a plurality of notches, each said notch being aligned with one of said termination boxes, wherein said wire windings pass through said notch.

13. The blower assembly according to claim 10, wherein said end cap has at least one tab, and wherein said stator wall has at least one tab receptacle, said at least one tab receivable in said at least one tab receptacle to releasably secure said end cap to said stator wall.

14. A diffuser for a blower assembly, wherein the diffuser carries a motor assembly and a shrouded fan assembly, the motor assembly having a shaft that rotates a fan in the shrouded fan assembly, the diffuser comprising:

a plate having a fan side opposite a motor side and a shaft hole therethrough, said plate having a plurality of ports extending therethrough;

a stator wall extending from said motor side, said stator wall partially enclosing the motor assembly; and an end cap coupled to said stator wall for further enclosing the motor assembly, wherein said end cap has at least one tab and wherein said stator wall has at least one tab receptacle, said at least one tab receivable in said at least one tab receptacle to releasably secure said end cap to said stator wall.

15. The diffuser according to claim 14, wherein said tab receptacle is formed on an inner surface at said stator wall, said tab receptacle having an entry channel extending from a top edge of said stator wall, a lateral channel extending substantially perpendicularly from said entry channel, and a holding channel extending substantially perpendicularly from said lateral channel, wherein said tab is movable through said entry channel and said lateral channel and biasingly held by said spring in said holding channel.

16. The diffuser according to claim 15, wherein said end cap has a non-circular member extending from one side and a bearing collar on an opposite side, said bearing collar receiving said spring, wherein said non-circular member facilitates securement of said end cap to said stator wall.

17. The diffuser according to claim 14, further comprising:

a spring interposed between said end cap and the motor assembly to bias said end cap into a secure position.

18. The diffuser according to claim 14, further comprising:

a plurality of termination boxes disposed about the periphery of said stator wall, said motor assembly having wire windings that are terminated in at least some of said termination boxes.

19. The diffuser according to claim 18, wherein said stator wall has a plurality of notches, each said notch being aligned with one of said termination boxes, wherein said wire windings pass through said notch.

* * * * *

UNITED STATES PATENT AND TRADEMARK OFFICE

CERTIFICATE OF CORRECTION

PATENT NO. : 6,648,613 B2
DATED : November 18, 2003
INVENTOR(S) : Clausson et al.

It is certified that error appears in the above-identified patent and that said Letters Patent is hereby corrected as shown below:

Column 6,
Line 65, the word “position” should be -- positioned --

Column 8,
Line 8, after the word “channel” plase add the word -- and --
Line 12, replace the word “on” with -- extending from --

Signed and Sealed this

Eighteenth Day of May, 2004

JON W. DUDAS
*Acting Director of the United States Patent and Trademark Office*